US008327937B2

(12) United States Patent
Giem et al.

(10) Patent No.: US 8,327,937 B2
(45) Date of Patent: Dec. 11, 2012

(54) EQUIPMENT FOR REMOTE LAUNCHING OF CEMENTING PLUGS

(75) Inventors: Greg Giem, Houston, TX (US); Philippe Gambier, Luanda Port (AO); Chris Fitzgerald, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 386 days.

(21) Appl. No.: 12/640,622

(22) Filed: Dec. 17, 2009

(65) Prior Publication Data

US 2011/0146986 A1 Jun. 23, 2011

(51) Int. Cl.
*E21B 33/16* (2006.01)
*E21B 33/13* (2006.01)

(52) U.S. Cl. ..... 166/291; 166/386; 166/153; 166/177.4

(58) Field of Classification Search ..... 166/285, 166/291, 386, 187, 153, 155, 177.4
See application file for complete search history.

(56) References Cited

U.S. PATENT DOCUMENTS

| | | | | |
|---|---|---|---|---|
| 3,616,850 | A | 11/1971 | Scott | |
| 3,863,716 | A | 2/1975 | Streich | |
| 4,042,014 | A | 8/1977 | Scott | |
| 4,574,882 | A | 3/1986 | Szarka | |
| 4,624,312 | A | 11/1986 | McMullin | |
| 4,958,686 | A | 9/1990 | Putch | |
| 5,004,048 | A | 4/1991 | Bode | |
| 5,095,988 | A | 3/1992 | Bode | |
| 5,435,390 | A | 7/1995 | Baugh et al. | |
| 5,553,667 | A | 9/1996 | Budde et al. | |
| 5,590,713 | A | 1/1997 | Baugh et al. | |
| 5,787,979 | A | 8/1998 | Giroux et al. | |
| 5,813,457 | A | 9/1998 | Giroux et al. | |
| 5,833,002 | A | 11/1998 | Holcombe | |
| 5,890,537 | A | 4/1999 | Lavaure et al. | |
| 5,950,724 | A | 9/1999 | Giebeler | |
| 5,950,725 | A | 9/1999 | Rondeau et al. | |
| 6,056,053 | A | 5/2000 | Giroux et al. | |
| 6,799,638 | B2 | 10/2004 | Butterfield, Jr. | |
| 6,802,372 | B2 | 10/2004 | Budde | |
| 7,143,831 | B2 | 12/2006 | Budde | |
| 7,255,162 | B2 * | 8/2007 | Stevens et al. | 166/75.15 |
| 2003/0164237 | A1 | 9/2003 | Butterfield, Jr. | |

(Continued)

FOREIGN PATENT DOCUMENTS

| | | |
|---|---|---|
| EP | 500165 | 8/1992 |

(Continued)

OTHER PUBLICATIONS

B. Piot, G. Cuvillier, "Primary Cementing", Well Cementing, Second Edition by E. Nelson and D. Guillot, pp. 459-501.

(Continued)

*Primary Examiner* — Jennifer H Gay
(74) *Attorney, Agent, or Firm* — Matthias Abrell

(57) ABSTRACT

An apparatus for remotely launching cementing plugs is configured such that the length of a dart need not necessarily be the same as the corresponding plug to be launched. A hydraulic-liquid reservoir and a piston are incorporated into a plug-launching system. The size of the reservoir may be adjusted such that the axial displacement of the piston after the dart lands is sufficient to cause the expulsion of a plug from the apparatus.

20 Claims, 2 Drawing Sheets

U.S. PATENT DOCUMENTS

| | | | | |
|---|---|---|---|---|
| 2004/0231836 | A1 | 11/2004 | Budde | |
| 2006/0027122 | A1 | 2/2006 | Arce et al. | |
| 2011/0067865 | A1 * | 3/2011 | Rondeau | 166/285 |
| 2011/0067866 | A1 * | 3/2011 | Rondeau et al. | 166/292 |
| 2011/0146986 | A1 * | 6/2011 | Giem et al. | 166/291 |
| 2011/0240316 | A1 * | 10/2011 | Rondeau | 166/386 |
| 2011/0290481 | A1 * | 12/2011 | Rondeau et al. | 166/265 |
| 2012/0031614 | A1 * | 2/2012 | Rondeau et al. | 166/293 |

FOREIGN PATENT DOCUMENTS

| | | | |
|---|---|---|---|
| EP | 450676 | | 6/1995 |
| EP | 0905349 | | 3/1999 |
| EP | 1340882 | | 9/2003 |
| EP | 1496193 | | 1/2005 |
| EP | 2196619 | A1 * | 6/2010 |
| EP | 2199537 | A1 * | 6/2010 |
| EP | 2199540 | A1 * | 6/2010 |
| WO | 9428282 | | 12/1994 |
| WO | 98/25004 | | 6/1998 |
| WO | 2006014939 | | 2/2006 |
| WO | WO 2010072319 | A1 * | 7/2010 |

OTHER PUBLICATIONS

E. Leugemors, et al, "Cementing Equipment and Casing Hardware," Well Cementing, Second Edition by E. Nelson and D. Guillot, pp. 343-434.

W. Brandt, et al., "Deepening the Search for Offshore Hydrocarbons," Oilfield Review (Spring 1998) 10, No. 1 pp. 2-21.

* cited by examiner

EQUIPMENT FOR REMOTE LAUNCHING OF CEMENTING PLUGS

BACKGROUND OF THE INVENTION

The statements in this section merely provide background information related to the present disclosure and may not constitute prior art.

The present invention is related in general to equipment for servicing subterranean wells. Particularly, the invention relates to an apparatus and method for remotely launching cementing plugs during the primary cementation of a subterranean well.

Most primary cementing treatments involve the use of wiper plugs that travel through the interior of a tubular body (e.g., casing or liner). When launched, the plugs travel from the top of the tubular body to the bottom, where they become seated. The purpose of the plugs is to separate and prevent commingling of different fluids during their journey through the tubular body. In most cases, operators deploy a bottom plug and a top plug.

After the tubular body is installed in the wellbore, the annulus between the tubular body and the wellbore wall (or another tubular body) is usually filled with drilling fluid. When the primary cementing treatment commences, the bottom plug is first launched into the tubular body, followed by the cement slurry. The cement slurry may be preceded by a spacer fluid, a chemical wash or both. The function of the bottom plug is to scrape traces of drilling fluid from the internal surface of the tubular body, and to prevent contact between the drilling fluid and the cement slurry.

The bottom-plug launching and conveyance through the tubular body arises from pressure applied by the cement slurry. When the bottom plug completes its journey through the tubular body, it becomes seated on float equipment installed at the bottom of the tubular body. Continued pumping exerts sufficient pressure to rupture a membrane at the top of the bottom plug, allowing the cement slurry to flow through an interior passage in the bottom plug, exit the bottom of the tubular body and continue into the annulus.

After sufficient cement slurry to fill the annulus has been pumped into the tubular body, the top plug is launched into the tubular body, and a displacement fluid is pumped behind the plug. The displacement fluid forces the plug through the tubular body. Displacement fluids may comprise (but not be limited to) water, spacer fluids and completion fluids. The function of the top plug is to scrape traces of cement slurry from the internal surface of the tubular body, isolate the cement slurry from the displacement fluid and, upon landing on the bottom plug, seal the tubular body interior from the annulus. Unlike the bottom plug, the top plug has no membrane or interior passage through which fluids may flow.

A thorough description of the primary cementing process and the equipment employed to perform the service may be found in the following references. (1) Piot B. and Cuvillier G.: "Primary Cementing," in Nelson E. B. and Guillot D. (eds.): *Well Cementing*-2$^{nd}$ Edition, Houston: Schlumberger (2006): 459-501. (2) Leugemors E., Metson J., Pessin J.-L., Colvard R. L., Krauss C. D. and Plante M.: "Cementing Equipment and Casing Hardware," in Nelson E. B. and Guillot D. (eds.): *Well Cementing*-2$^{nd}$ Edition, Houston: Schlumberger (2006): 343-434.

Wiper plugs are usually launched from a cementing head that is attached to the tubular body near the drilling rig. The tubular body rises from the bottom of the openhole to the rig floor. However, for subsea completions, the problem becomes more complicated, and fluid isolation becomes more and more critical as water depth increases. It thus becomes impractical to launch wiper plugs from the surface. Therefore, the cementing head containing the wiper plugs rests on the seafloor, and the top of the tubular body ends at the mudline. Drillpipe connects the top of the tubular body to the rig floor on the surface. During the cementing process, darts are released into the drillpipe on surface, travel through the drillpipe to the seafloor and, upon arrival, trigger the release of the wiper plugs.

After the first dart is launched, cement slurry is pumped behind it. When the first dart lands inside the cementing head, the bottom plug is released. The second dart is launched after sufficient cement slurry has been pumped to fill the annulus. A displacement fluid is pumped behind the second dart. When the second dart arrives, the top plug is released. A brief peak in surface pressure indicates when each wiper plug has been launched. This process is detailed in the following references: (1) Buisine P. and Lavaure G.: "Equipment for Remote Launching of Cementing Plugs into Subsea Drilled Wells," European Patent Application 0 450 676 A1 (1991); (2) Brandt W. et al.: "Deepening the Search for Offshore Hydrocarbons." *Oilfield Review* (Spring 1998) 10, No. 1, 2-21.

Those skilled in the art will understand that process fluids may comprise drilling fluids, cement slurries, chemical washes, spacer fluids and completion fluids.

Previous plug-launching systems are configured such that the length of the dart must match the length of the plug being launched. The arrival and displacement of the dart inside the cementing head causes a rod and piston to likewise move downward into the plug basket. The distance the rod and piston move downward is equal to the axial displacement distance of the dart. The cementing-plug length may vary depending upon the casing size into which it is being launched. Therefore, it is necessary for the operator to have various sizes of darts available.

The necessity for the dart length to be equal to the plug length may also pose ergonomic problems. When longer plugs are employed, the length of the dart launching apparatus may be difficult to handle on offshore facilities.

Despite the valuable contributions of the prior art, it remains desirable, therefore, to provide an improved apparatus and methods for launching various sizes of cementing plugs.

SUMMARY OF THE INVENTION

The present invention fulfills the needs mentioned herein.

The first aspect is a system for launching cementing plugs in a subterranean well. The system comprises two portions. The first portion comprises a plug basket that initially contains at least one plug, a dart catcher that contains a hydraulic-liquid reservoir and a piston, ports through which wellbore-service fluids may flow, and a hydraulic liquid inside the reservoir that is in hydraulic communication with the plug basket. The second portion comprises at least one dart. The second portion is initially separated from the first portion. The system is designed such that, upon arrival and subsequent axial movement of the dart inside the dart catcher, the hydraulic liquid is displaced by the piston to a sufficient extent to cause the expulsion of the plug from the system.

The second aspect is a method for launching cementing plugs. The method comprises a system for launching cementing plugs in a subterranean well which comprises two portions. The first portion comprises a plug basket that initially contains at least one plug, a dart catcher that contains a hydraulic-liquid reservoir and a piston, ports through which wellbore-service fluids may flow, and a hydraulic liquid inside the reservoir that is in hydraulic communication with the plug basket. The second portion comprises at least one dart. The second portion is initially separated from the first portion. The system is designed such that, upon arrival and subsequent axial movement of the dart inside the dart catcher, the hydraulic liquid is displaced by the piston to a sufficient extent to cause the expulsion of the plug from the system.

The first portion of the system is installed inside a casing string. Process fluid is pumped into the first portion, and allowed to flow through the flow ports. A dart is launched into the process-fluid stream. Pumping of process fluid continues until the dart lands on the piston inside the dart catcher, blocking process-fluid flowing through the flow ports. Continued process-fluid pumping causes the piston to move downward into the hydraulic-liquid reservoir, forcing the plug to exit the plug basket.

The third aspect is a method for cementing a subterranean well. The method comprises a system for launching cementing plugs in a subterranean which comprises two portions. The first portion comprises a plug basket that initially contains at least one plug, a dart catcher that contains a hydraulic-liquid reservoir and a piston, ports through which wellbore-service fluids may flow, and a hydraulic liquid inside the reservoir that is in hydraulic communication with the plug basket. The second portion comprises at least one dart. The second portion is initially separated from the first portion. The system is designed such that, upon arrival and subsequent axial movement of the dart inside the dart catcher, the hydraulic liquid is displaced by the piston to a sufficient extent to cause the expulsion of the plug from the system.

The first portion of the system is installed inside a casing string. Drilling fluid is pumped into the first portion, and allowed to flow through the flow ports. A dart is launched into the drilling-fluid stream. Cement slurry is pumped behind the dart. Pumping of cement slurry continues until the dart lands on the piston inside the dart catcher, blocking fluid flow through the flow ports. Continued cement-slurry pumping causes the piston to move downward into the hydraulic-liquid reservoir, forcing the plug to exit the plug basket.

DETAILED DESCRIPTION

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

When cementing the annular space between tubulars and the walls of a subterranean wellbore, it is usually necessary to minimize or prevent the commingling of the drilling fluid, spacer fluid and cement slurry. Commingling may result, for example, in adverse rheological effects, dilution of the cement slurry and compromised zonal isolation. One way to minimize commingling involves using wiper plugs to separate fluids as they travel down the tubulars. Wiper plugs also clean the inner surface of the tubulars. Most cementing operations involve two wiper plugs: a bottom plug that separates cement slurry from drilling fluid, and a bottom plug that separates cement slurry from displacement fluid. The bottom plug travels through the tubular body (e.g., casing) and lands on float equipment at the bottom end. Continued pumping breaks a membrane in the bottom plug, allowing cement slurry to pass through the plug and enter the annular region around the tubular body. The top plug lands on top of the bottom plug, forcing the cement slurry out of the tubular-body interior, and leaving the tubular-body interior full of displacement fluid.

The present invention is aimed at simplifying and improving the ergonomics of cementing-plug launching systems. One of the principal features of the invention is that it is no longer necessary for the length of a dart to be equal to that of the corresponding cementing plug to be launched.

The first aspect of the invention is a system for launching cementing plugs in a subterranean well. The system comprises two portions. The first portion comprises a plug basket that initially contains at least one plug, a dart catcher that contains a hydraulic-liquid reservoir and a piston, ports through which wellbore-service fluids may flow, and a hydraulic liquid inside the reservoir that is in hydraulic communication with the plug basket. The second portion comprises at least one dart. The second portion is initially separated from the first portion. The system is designed such that, upon arrival and subsequent axial movement of the dart inside the dart catcher, the hydraulic liquid is displaced by the piston to a sufficient extent to cause the expulsion of the plug from the system.

Figures 1A, 1B, 1C, 1D, 1E:
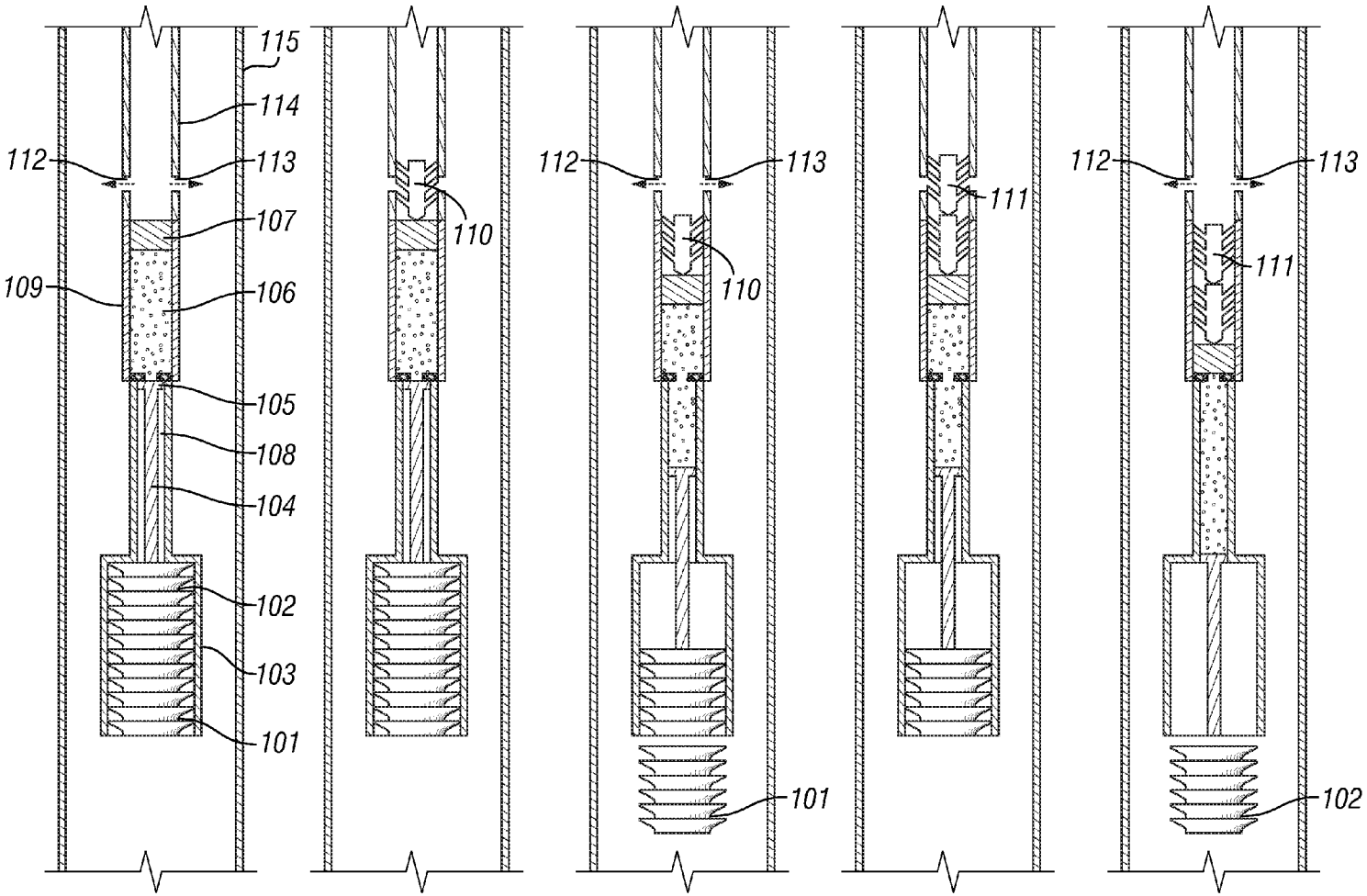
FIG. 1 illustrates the design and operation of an embodiment of the invention in which hydraulic fluid may flow from the dart catcher into a tubular body connected to the plug basket.
Figure 2E:
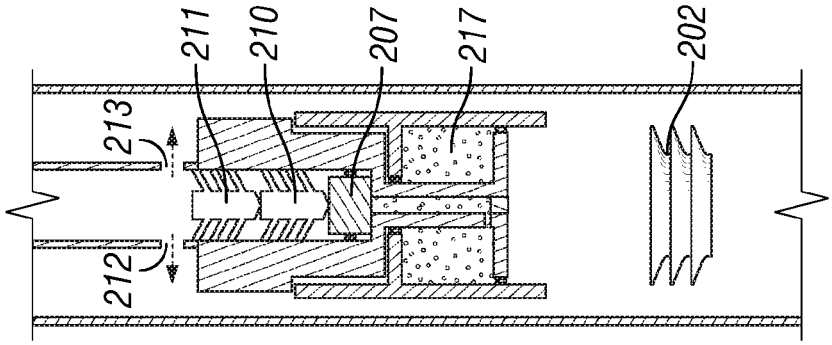
FIG. 2 illustrates the design and operation of another embodiment of the invention that features an expandable fluid chamber and a movable plug basket.
Figure 2D:
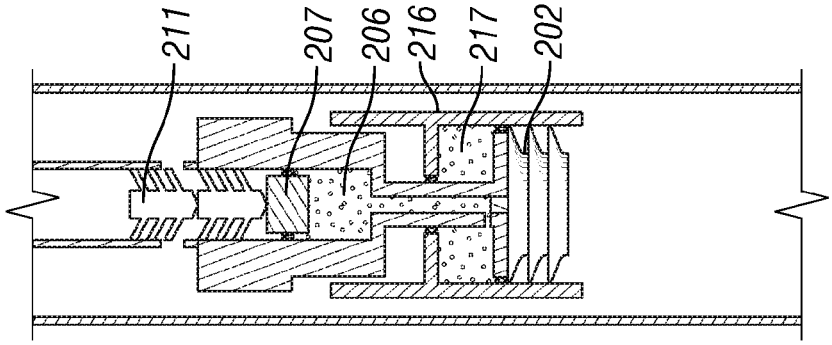
Figure 2C:
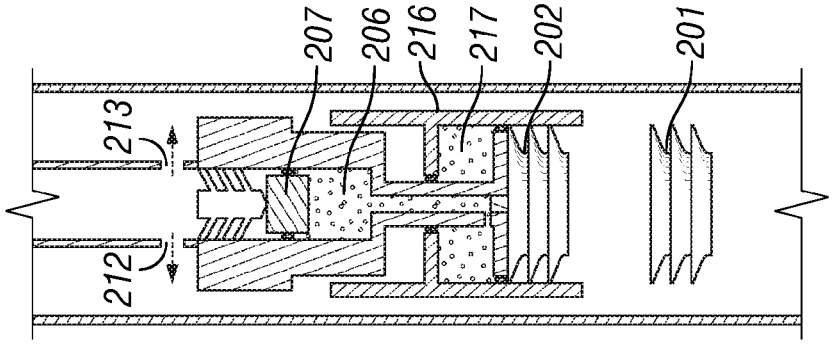
Figure 2B:
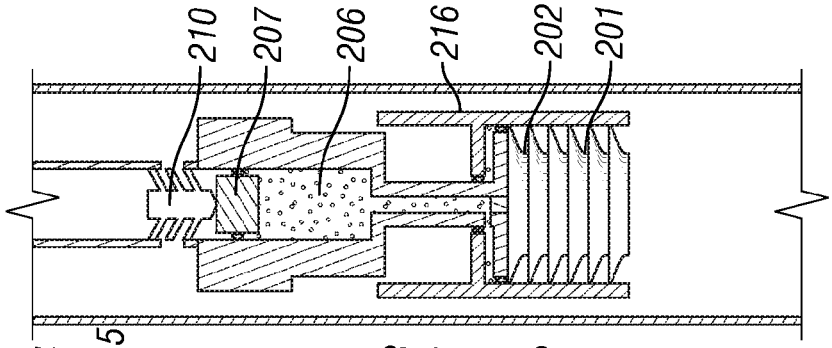
Figure 2A:
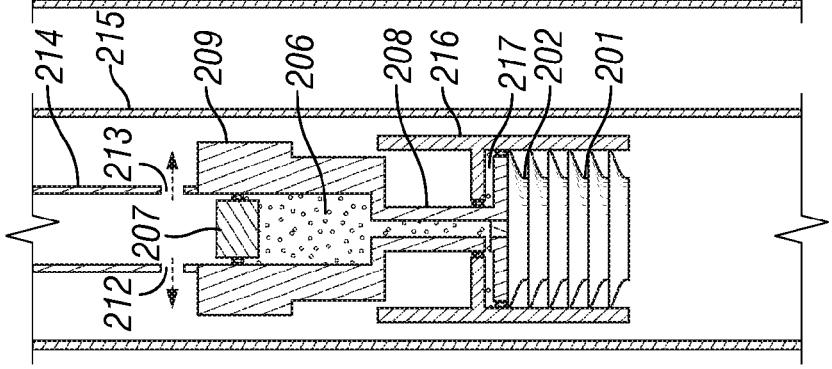

Embodiment of the first aspect of the invention, shown in FIG. 1, may have the following characteristics. The first portion further may comprise at least one bottom plug 101 and a top plug 102 in the plug basket 103. Above the plug basket 103 may be a first tubular body 108 containing a main rod 104 equipped with a rod piston 105. A dart catcher 109 may be mounted above the first tubular body 108. The dart catcher may contain a hydraulic-liquid reservoir 106 and a piston 107. Hydraulic liquid from the reservoir 106 may flow into the first tubular body 108, causing downward movement of the rod piston 105 and main rod 104. Above the dart catcher may be a second tubular body 114 containing ports (112 and 113) through which wellbore-service fluids may flow. The second portion may comprise at least one bottom dart 110, and the system may further comprise a third portion comprising a top dart 111. The second and third portions may initially be separated from the first portion.

The internal volumes of the hydraulic-liquid reservoir 106 and the first tubular body 108 may be adjusted such that the axial displacement of rod piston 105 and main rod 104, resulting from the axial displacement of piston 107, and the flow of hydraulic liquid into the first tubular body 108, is sufficient to expel a plug.

Yet other embodiment of the first aspect of the invention, shown in FIG. 2, may have the following characteristics. The plug basket 216 of the first portion may be movable and may initially contain at least one bottom plug 201 and a top plug 202. The first portion may further comprise a first tubular body 208 through which hydraulic fluid may flow. The first tubular body 208 may be be mounted between the movable plug basket 216 and the dart catcher 209. Hydraulic liquid may flow from the hydraulic-liquid reservoir 216 into the first tubular body 208 and then into an expandable fluid chamber 217. Expansion of the fluid chamber 217 upon entry of hydraulic fluid may cause the plug basket 216 to move upward, resulting in the expulsion of a cementing plug (201 or 202). Above the dart catcher may be a second tubular body 214 containing ports (212 and 213) through which wellbore-service fluids may flow. The second portion may comprise at least one bottom dart 210, and the system may further comprise a third portion comprising a top dart 211. The second and third portions may initially be separated from the first portion.

The internal volumes of the hydraulic-fluid reservoir 206 and the first tubular body 208 may be adjusted such that hydraulic-fluid movement through the first tubular body 208, and subsequent filling of the expandable fluid chamber 217 arising from the arrival and displacement of a dart, cause the movable dart basket 216 to move sufficiently upward to expel a plug.

The second aspect of the invention is a method for launching cementing plugs. The method comprises a system for launching cementing plugs in a subterranean well which comprises two portions. The first portion comprises a plug basket that initially contains at least one plug, a dart catcher that contains a hydraulic-liquid reservoir and a piston, ports through which wellbore-service fluids may flow, and a hydraulic liquid inside the reservoir that is in hydraulic communication with the plug basket. The second portion comprises at least one dart. The second portion is initially separated from the first portion. The system is designed such that, upon arrival and subsequent axial movement of the dart inside the dart catcher, the hydraulic liquid is displaced by the piston to a sufficient extent to cause the expulsion of the plug from the system.

The first portion of the system is installed inside a casing string. Process fluid is pumped into the first portion, and allowed to flow through the flow ports. A dart is launched into the process-fluid stream. Pumping of process fluid continues until the dart lands on the piston inside the dart catcher, blocking process-fluid flow through the flow ports. Continued process-fluid pumping causes the piston to move downward into the hydraulic-liquid reservoir, forcing the plug to exit the plug basket.

Another embodiment of the second aspect of the invention is described below. The system selected for launching cementing plugs in a subterranean well may be further characterized by the following. The first portion may comprise at least one bottom plug 101 and a top plug 102 in the plug basket 103. Above the plug basket 103 may be a first tubular body 108 containing a main rod 104 equipped with a rod piston 105. A dart catcher 109 may be mounted above the first tubular body 108. The dart catcher may contain a hydraulic-liquid reservoir 106 and a piston 107. Hydraulic liquid from the reservoir 106 may flow into the first tubular body 108, causing downward movement of the rod piston 105 and main rod 104. Above the dart catcher may be a second tubular body 114 containing ports (112 and 113) through which wellbore-service fluids may flow. The second portion may comprise at least one bottom dart 110, and the system may further comprise a third portion comprising a top dart 111. The second and third portions may initially be separated from the first portion.

This embodiment may further comprise the following steps. The first portion is preferably installed inside a casing string 115. A first process fluid is pumped from the surface through the second tubular body 114. As shown in Step A, process fluid initially flows through ports 112 and 113, bypassing the rest of the first portion of the apparatus. A bottom dart 110 is launched into the process-fluid stream in the second tubular body 114. A second process fluid may be pumped behind the bottom dart 110. After a desired volume of second process fluid has been pumped into the well, a top dart 111 may be launched into the process fluid stream in the second tubular body 114, followed by a third process fluid.

Step B depicts the moment during which the bottom dart 110 lands on the piston 7 inside the dart catcher 9. The bottom dart blocks fluid flow through ports 112 and 113. As shown by Step C, further pumping of process fluid forces the bottom dart 110 downward, thereby forcing the piston 107 downward, thereby causing hydraulic liquid from the hydraulic-liquid reservoir 106 into the first tubular body 108, thereby forcing the piston 107 downward. Movement of the piston 107 forces the main rod 105 into the plug basket 103, thereby ejecting the bottom plug 101 from the plug basket. The bottom plug 101 may act as a barrier between the first and second process fluids, preventing their commingling while traveling through the interior of the casing string 115.

In Step D, the top dart 111 has landed on the bottom dart 110, once again obstructing fluid flow through ports 112 and 113. A shown by Step E, further pumping causes the top dart 111 to move downward, thereby causing more hydraulic liquid to flow from the hydraulic-liquid reservoir 106 into the first tubular body 108, thereby forcing the piston 107 further downward. Movement of the piston 107 forces the main rod 105 further into the plug basket 103, thereby ejecting the top plug 102 from the plug basket. The top plug 102 may act as a barrier between the second and third process fluids, preventing their commingling while traveling through the interior of the casing string 115.

The internal volumes of the hydraulic-liquid reservoir 106 and the first tubular body 108 may be adjusted such that the axial displacement of rod piston 105 and main rod 104, resulting from the axial displacement of piston 107, and the flow of hydraulic liquid into the first tubular body 108, is sufficient to expel a plug.

It will be understood by those skilled the art that the internal volume of the second tubular body 114 may be less than the amount of second process fluid necessary to fill the annular region surrounding the casing string 115. In such cases, the second portion of the first aspect of the invention, the bottom dart 110, will reach the first portion of the first aspect of the invention before the desired quantity of second process fluid has been pumped into the second tubular body 114. Thus, the bottom plug 101 may be launched before the top dart 111 is launched.

Yet another embodiment of the second aspect of the invention is described below. The system selected for launching cementing plugs in a subterranean well may be further characterized by the following. The plug basket 216 of the first portion may be movable and initially contains at least one bottom plug 201 and a top plug 202. The first portion may further comprise a first tubular body 208 through which hydraulic fluid may flow. The first tubular body 208 may be mounted between the movable plug basket 216 and the dart catcher 209. Hydraulic liquid may flow from the hydraulic-liquid reservoir 216 into the first tubular body 208 and then into an expandable fluid chamber 217. Expansion of the fluid chamber 217 upon entry of hydraulic fluid causes the plug basket 216 to move upward, resulting in the expulsion of a cementing plug (201 or 202). Above the dart catcher may be a second tubular body 214 containing ports (212 and 213) through which wellbore-service fluids may flow. The second portion may comprise at least one bottom dart 210, and the system may further comprise a third portion comprising a top dart 211. The second and third portions may initially be separated from the first portion.

This embodiment may further comprise the following steps. The first portion is preferably installed inside a casing string 215. A first process fluid may be pumped from the surface through the second tubular body 214. As shown in Step A, the first process fluid may initially flow through ports 212 and 213, bypassing the rest of the first portion of the apparatus. A bottom dart 210 may be launched into the first-process-fluid stream in the second tubular body 214. A second process fluid may be pumped behind the bottom dart 210. After a desired volume of second process fluid has been pumped into the well, a top dart 211 may be launched into the second-process-fluid stream in the second tubular body 214, followed by a third process fluid.

Step B depicts the moment during which the bottom dart 210 lands on the piston 207 inside the dart catcher 209. The bottom dart may block fluid flow through ports 212 and 213. As shown by Step C, further pumping forces the bottom dart 210 downward, thereby forcing the piston 207 downward, thereby causing hydraulic liquid from the hydraulic-liquid reservoir 206 into the first tubular body 208, thereby entering and beginning to fill the expandable fluid chamber 217. Continued pumping and filling of the expandable fluid chamber 217 forces the plug basket 216 to move upward, thereby expelling the bottom cementing plug 201. The bottom plug 201 may act as a barrier between the first and second process fluids, preventing their commingling while traveling through the interior of the casing string 215.

In Step D, the top dart 211 has landed on the bottom dart 210, once again obstructing fluid flow through ports 212 and 213. A shown by Step E, further pumping causes the top dart 211 to move downward, thereby causing more hydraulic liquid to flow from the hydraulic-liquid reservoir 206 into the first tubular body 208, thereby entering and further filling the expandable fluid chamber 217. Continued pumping and filling of the expandable fluid chamber 217 forces the plug basket 216 to once again move upward, thereby expelling the top cementing plug 202. The top plug 202 may act as a barrier between the second and third process fluids, preventing their commingling while traveling through the interior of the casing string 215.

The internal volumes of the hydraulic-fluid reservoir 206 and the first tubular body 208 may be adjusted such that hydraulic-fluid movement through the first tubular body 208, and subsequent filling of the expandable fluid chamber 217 arising from the arrival and displacement of a dart, cause the movable dart basket 216 to move sufficiently upward to expel a plug.

It will be understood by those skilled the art that the internal volume of the second tubular body 214 may be less than the amount of second process fluid necessary to fill the annular region surrounding the casing string 215. In such cases, the second portion of the first aspect of the invention, the bottom dart 210, will reach the first portion of the first aspect of the invention before the desired quantity of second process fluid has been pumped into the second tubular body 214. Thus, the bottom plug 201 may be launched before the top dart 211 is launched.

The third aspect of the invention is a method for cementing a subterranean well. The method comprises a system for launching cementing plugs in a subterranean well which comprises two portions. The first portion comprises a plug basket that initially contains at least one plug, a dart catcher that contains a hydraulic-liquid reservoir and a piston, ports through which wellbore-service fluids may flow, and a hydraulic liquid inside the reservoir that is in hydraulic communication with the plug basket. The second portion comprises at least one dart. The second portion is initially separated from the first portion. The system is designed such that, upon arrival and subsequent axial movement of the dart inside the dart catcher, the hydraulic liquid is displaced by the piston to a sufficient extent to cause the expulsion of the plug from the system.

The first portion of the system is preferably installed inside a casing string. Drilling fluid is pumped into the first portion, and allowed to flow through the flow ports. A dart is launched into the drilling-fluid stream. Cement slurry is pumped behind the dart. Pumping of cement slurry continues until the dart lands on the piston inside the dart catcher, blocking fluid flow through the flow ports. Continued cement-slurry pumping causes the piston to move downward into the hydraulic-liquid reservoir, forcing the plug to exit the plug basket. It will be understood by those skilled in the art that the cement slurry may be preceded by a chemical wash, spacer fluid or both.

Another embodiment of the third aspect of the invention is described below. The system selected for launching cementing plugs in a subterranean well may be further characterized by the following. The first portion may comprise at least one bottom plug 101 and a top plug 102 in the plug basket 103. Above the plug basket 103 may be a first tubular body 108 containing a main rod 104 equipped with a rod piston 105. A dart catcher 109 may be mounted above the first tubular body 108. The dart catcher may contain a hydraulic-liquid reservoir 106 and a piston 107. Hydraulic liquid from the reservoir 106 may flow into the first tubular body 108, causing downward movement of the rod piston 105 and main rod 104. Above the dart catcher may be a second tubular body 114 containing ports (112 and 113) through which wellbore-service fluids may flow. The second portion may comprise at least one bottom dart 110, and the system may further comprise a third portion comprising a top dart 111. The second and third portions may initially be separated from the first portion.

This embodiment may further comprise the following steps. The first portion is preferably installed inside a casing string 115. Drilling fluid may be pumped from the surface through the second tubular body 114. As shown in Step A, drilling fluid may initially flow through ports 112 and 113, bypassing the rest of the first portion of the apparatus. A bottom dart 110 may be launched into the drilling-fluid stream in the second tubular body 114. Cement slurry may be pumped behind the bottom dart 110. After a desired volume of cement slurry has been pumped into the well, a top dart 111 may be launched into the cement-slurry stream in the second tubular body 114, followed by a displacement fluid.

Step B depicts the moment during which the bottom dart 110 lands on the piston 7 inside the dart catcher 9. The bottom dart may block fluid flow through ports 112 and 113. As shown by Step C, further pumping of displacement fluid may force the bottom dart 110 downward, thereby forcing the piston 107 downward, thereby causing hydraulic liquid from the hydraulic-liquid reservoir 106 into the first tubular body 108, thereby forcing the piston 107 downward. Movement of the piston 107 may force the main rod 105 into the plug basket 103, thereby ejecting the bottom plug 101 from the plug basket. The bottom plug 101 may act as a barrier between the drilling fluid and cement slurry, preventing their commingling while traveling through the interior of the casing string 115.

In Step D, the top dart 111 has landed on the bottom dart 110, once again obstructing fluid flow through ports 112 and 113. A shown by Step E, further pumping may cause the top dart 111 to move downward, thereby causing more hydraulic liquid to flow from the hydraulic-liquid reservoir 106 into the first tubular body 108, thereby forcing the piston 107 further downward. Movement of the piston 107 may force the main rod 105 further into the plug basket 103, thereby ejecting the top plug 102 from the plug basket. The top plug 102 may act as a barrier between the cement slurry and displacement fluid, preventing their commingling while traveling through the interior of the casing string 115.

The internal volumes of the hydraulic-liquid reservoir 106 and the first tubular body 108 may be adjusted such that the axial displacement of rod piston 105 and main rod 104, resulting from the axial displacement of piston 107, and the flow of hydraulic liquid into the first tubular body 108, is sufficient to expel a plug.

It will be understood by those skilled the art that the internal volume of the second tubular body 114 may be less than the amount of cement slurry necessary to fill the annular region surrounding the casing string 115. In such cases, the second portion of the first aspect of the invention, the bottom dart 110, will reach the first portion of the first aspect of the invention before the desired quantity of cement slurry has been pumped into the second tubular body 114. Thus, the bottom plug 101 may be launched before the top dart 111 is launched.

It will also be understood by those skilled in the art that the cement slurry may be preceded by a chemical wash, spacer fluid or both.

Yet another embodiment of the third aspect of the invention is described below. The system selected for launching cementing plugs in a subterranean well may be further characterized by the following. The plug basket 216 of the first portion may be movable and may initially contain at least one bottom plug 201 and a top plug 202. The first portion may further comprise a first tubular body 208 through which hydraulic fluid may flow. The first tubular body 208 may be be mounted between the movable plug basket 216 and the dart catcher 209. Hydraulic liquid may flow from the hydraulic-liquid reservoir 216 into the first tubular body 208 and then into an expandable fluid chamber 217. Expansion of the fluid chamber 217 upon entry of hydraulic fluid may cause the plug basket 216 to move upward, resulting in the expulsion of a cementing plug (201 or 202). Above the dart catcher may be a second tubular body 214 containing ports (212 and 213) through which wellbore-service fluids may flow. The second portion may comprise at least one bottom dart 210, and the system may further comprise a third portion comprising a top dart 211. The second and third portions may initially be separated from the first portion.

This embodiment may further comprise the following steps. The first portion is preferably installed inside a casing string 215. Drilling fluid may be pumped from the surface through the second tubular body 214. As shown in Step A, the drilling fluid may initially flow through ports 212 and 213, bypassing the rest of the first portion of the apparatus. A bottom dart 210 may be launched into the drilling-fluid stream in the second tubular body 214. Cement slurry may be pumped behind the bottom dart 210. After a desired volume of cement slurry has been pumped into the well, a top dart 211 may be launched into the cement-slurry stream in the second tubular body 214, followed by a displacement fluid.

Step B depicts the moment during which the bottom dart 210 lands on the piston 207 inside the dart catcher 209. The bottom dart may block fluid flow through ports 212 and 213. As shown by Step C, further pumping may force the bottom dart 210 downward, thereby forcing the piston 207 downward, thereby causing hydraulic liquid from the hydraulic-liquid reservoir 206 into the first tubular body 208, thereby entering and beginning to fill the expandable fluid chamber 217. Continued pumping and filling of the expandable fluid chamber 217 may force the plug basket 216 to move upward, thereby expelling the bottom cementing plug 201. The bottom plug 201 may act as a barrier between the drilling fluid and cement slurry, preventing their commingling while traveling through the interior of the casing string 215.

In Step D, the top dart 211 has landed on the bottom dart 210, once again obstructing fluid flow through ports 212 and 213. A shown by Step E, further pumping may cause the top dart 211 to move downward, thereby causing more hydraulic liquid to flow from the hydraulic-liquid reservoir 206 into the first tubular body 208, thereby entering and further filling the expandable fluid chamber 217. Continued pumping and filling of the expandable fluid chamber 217 may force the plug basket 216 to once again move upward, thereby expelling the top cementing plug 202. The top plug 202 may act as a barrier between the cement slurry and the displacement fluid, preventing their commingling while traveling through the interior of the casing string 215.

The internal volumes of the hydraulic-fluid reservoir 206 and the first tubular body 208 may be adjusted such that hydraulic-fluid movement through the first tubular body 208, and subsequent filling of the expandable fluid chamber 217 arising from the arrival and displacement of a dart, cause the movable dart basket 216 to move sufficiently upward to expel a plug.

It will be understood by those skilled the art that the internal volume of the second tubular body 214 may be less than the amount of second process fluid necessary to fill the annular region surrounding the casing string 215. In such cases, the second portion of the first aspect of the invention, the bottom dart 210, will reach the first portion of the first aspect of the invention before the desired quantity of second process fluid has been pumped into the second tubular body 214. Thus, the bottom plug 201 may be launched before the top dart 211 is launched.

It will also be understood by those skilled in the art that the cement slurry may be preceded by a chemical wash, spacer fluid or both.

For all aspects of the invention, the hydraulic liquid may comprise a member of the list comprising: water, mineral oil, glycols, esters, polyalphaolefins or silicone oils and mixtures thereof.

For all aspects of the invention, the subterranean well may be a member of the list comprising: an oil well, a gas well, a geothermal well, a water well, a well for chemical-waste disposal, a well for enhanced recovery of hydrocarbons and a well for carbon sequestration.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A system for launching cementing plugs in a subterranean well, comprising:

i. a first portion, comprising:

(a) a plug basket that initially contains at least one plug;

(b) a dart catcher that contains a hydraulic-liquid reservoir and a piston that forms a hydraulic seal in the reservoir;

(c) ports through which wellbore-service fluids may flow; and (d) a hydraulic liquid inside the reservoir that is in hydraulic communication with the plug basket; and ii. a second portion, comprising at least one dart, wherein, upon the arrival and subsequent axial movement of the dart within the dart catcher, the hydraulic liquid is displaced by the piston to a sufficient extent to cause the expulsion of the plug from the system.

2. The system of claim 1, wherein the hydraulic liquid comprises: water, mineral oil, glycols, esters, polyalphaolefins, silicone oils and mixtures thereof.

3. The system of claim 1, wherein:

i. the plug is a bottom plug and the dart is a bottom dart;

ii. the first portion further comprises:

(a) a top plug in the plug basket;

(b) a first tubular body that contains a main rod and a rod piston installed on the main rod;

(c) an opening in the dart catcher through which hydraulic liquid may flow into the first tubular body;

(d) a second tubular body comprising the ports through which wellbore-service fluids may flow; and iii. the system further comprises a third portion, comprising a top dart.

4. The system of claim 3, wherein the internal volumes of the hydraulic-liquid reservoir and the first tubular body are adjusted such that the axial displacement of the rod piston and the main rod, resulting from the axial displacement of the piston, and the flow of hydraulic liquid into the tubular body, is sufficient to expel a plug.

5. The system of claim 1, wherein:

i. the plug basket of the first portion is moveable and initially contains at least one bottom plug and a top plug:

ii. the first portion further comprises;

(a) a first tubular body through which hydraulic liquid may flow;

(b) an expandable fluid chamber into which hydraulic liquid may flow upon displacement through the first tubular body, thereby forcing the movable plug basked to move upward and expel a plug;

(c) ports in a second tubular body through which wellbore-service fluids may flow; and iii. the second portion comprises at least one bottom dart; and iv. the system further comprises a third portion, comprising a top dart.

6. The system of claim 5, wherein the internal volumes of the hydraulic-liquid reservoir and the first tubular body are adjusted such that hydraulic-liquid movement through the first tubular body, and subsequent filling of the expandable fluid chamber arising from the arrival and displacement of a dart, cause the movable plug basket to move sufficiently upward to expel a plug.

7. A method for launching cementing plugs in a subterranean well, comprising:

i. selecting a system for launching cementing plugs in a subterranean well, comprising:

(a) a first portion, comprising:

(i) a plug basket that initially contains at least one plug;

(ii) a dart catcher that contains a hydraulic-liquid reservoir and a piston that forms a hydraulic seal in the reservoir;

(iii) ports through which wellbore-service fluids may flow; and (iv) a hydraulic liquid inside the reservoir that is in hydraulic communication with the plug basket; and (b) a second portion, comprising at least one dart, wherein, upon the arrival and subsequent axial movement of the dart within the dart catcher, the hydraulic liquid is displaced by the piston to a sufficient extent to cause the expulsion of the plug from the system;

ii. installing the first portion of the system inside a casing string;

iii. pumping a process fluid into the first portion, allowing the process fluid to flow through the flow ports;

iv. launching the dart into the process-fluid stream;

v. continuing to pump process fluid until the dart lands on the piston inside the dart catcher, blocking process-fluid flow through the flow ports; and vi. continuing to pump process fluid until the dart clears the flow ports, causing the piston to move downward into the hydraulic-liquid reservoir, thereby forcing the plug to exit the plug basket.

8. The method of claim 7, wherein:

(1) the system selected for launching cementing plugs in a subterranean well is further characterized by the following:

(a) the plug is a bottom plug and the dart is a bottom dart;

(b) the first portion further comprises:

(i) a top plug in the plug basket;

(ii) a first tubular body that contains a main rod and a rod piston installed on the main rod;

(iii) an opening in the dart catcher through which hydraulic liquid may flow into the first tubular body;

(iv) a second tubular body comprising the ports through which wellbore-service fluids may flow; and (c) the system further comprises a third portion, comprising a top dart; and (2) the method further comprises:

i. pumping process fluid through the second tubular body inside the casing string, and allowing process fluid to flow through the flow ports in the second tubular body;

ii. launching the bottom dart into the process-fluid stream inside the second tubular body;

iii. pumping a desired volume of process fluid behind the bottom dart;

iv. launching the top dart into the process-fluid stream inside the second tubular body;

v. pumping process fluid behind the top dart;

vi. continuing to pump process fluid until the bottom dart lands on the piston inside the dart catcher, blocking process-fluid flow through the flow ports;

vii. continuing to pump process fluid until the bottom dart clears the flow ports, causing the piston to move downward into the hydraulic-liquid reservoir, thereby forcing hydraulic liquid inside the first tubular body, thereby forcing the rod piston and the main rod into the dart basket, thereby forcing the bottom plug to exit the plug basket;

viii. continuing to pump process fluid until the top dart lands on the bottom dart, blocking process-fluid flow through the ports; and ix. continuing to pump process fluid until the top dart clears the flow ports, thereby causing the piston to move further downward into the hydraulic-liquid reservoir, thereby forcing hydraulic liquid further inside the casing string, thereby forcing the rod piston and main rod further into the dart basket, thereby forcing the top plug to exit the plug basket.

9. The method of claim 8, wherein the internal volumes of the fluid reservoir and the first tubular body are adjusted such that the axial hydraulic-liquid displacement, and subsequent filling of the expandable fluid chamber arising from the arrival of the dart, are sufficient to cause the movable dart basket to move sufficiently upward to expel a plug.

10. The method of claim 7, wherein:

(1) the system selected for launching plugs in a subterranean well is further characterized by the following:

(a) the plug basket of the first portion is movable and initially contains at least one bottom plug and a top plug:

(b) the first portion further comprises:

(i) a first tubular body through which hydraulic liquid may flow;

(ii) an expandable fluid chamber into which hydraulic liquid may flow upon displacement through the first tubular body, thereby forcing the movable plug basket to move upward and expel a plug;

(iii) ports in a second tubular body through which wellbore-service fluids may flow; and (c) the second portion comprises at least one bottom dart; and (d) the system further comprises a third portion, comprising a top dart; and (2) the method further comprises the following steps:

i. pumping process fluid through the second tubular body inside the casing string, and allowing the process fluid to flow through the flow ports;

ii. launching the bottom dart into the process-fluid stream inside the second tubular body;

iii. pumping a desired volume of process fluid behind the bottom dart;

iv. launching the top dart into the process-fluid stream inside the second tubular body;

v. pumping process fluid behind the top dart;

vi. continuing to pump process fluid until the bottom dart lands on the piston inside the dart catcher, blocking process-fluid flow through the flow ports;

vii. continuing to pump process fluid until the bottom dart clears the flow ports, causing the piston to move downward into the hydraulic-liquid reservoir, thereby forcing hydraulic liquid through the first tubular body and into the expandable fluid chamber, thereby forcing the movable plug basket to move upward, thereby forcing the bottom plug to exit the movable plug basket;

viii. continuing to pump process fluid until the top dart lands on the bottom dart, blocking process-fluid flow through the flow ports; and ix. continuing to pump process fluid until the top dart clears the flow ports, thereby causing the piston to move further downward into the hydraulic-liquid reservoir, thereby forcing more hydraulic liquid through the first tubular body and into the expandable fluid chamber, thereby forcing the movable plug basket to move further upward, thereby forcing the top plug to exit the movable plug basket.

11. The method of claim 10, wherein the internal volumes of the fluid reservoir and the first tubular body are adjusted such that axial hydraulic-liquid displacement, and subsequent filling of the expandable fluid chamber arising from the arrival of the dart, are sufficient to cause the movable dart basket to move sufficiently upward to expel a plug.

12. A method for cementing a subterranean well, comprising:

i. selecting a system for launching cementing plugs in a subterranean well, comprising:

(a) a first portion, comprising:

(i) a plug basket that initially contains at least one plug;

(ii) a dart catcher that contains a hydraulic-liquid reservoir and a piston that forms a hydraulic seal in the reservoir;

(iii) ports through which wellbore-service fluids may flow; and (iv) a hydraulic liquid inside the reservoir that is in hydraulic communication with the plug basket; and (b) a second portion, comprising at least one dart, wherein, upon the arrival and subsequent axial movement of the dart within the dart catcher, the hydraulic liquid is displaced by the piston to a sufficient extent to cause the expulsion of the plug from the system;

ii. installing the first portion of the system inside a casing string;

iii. pumping drilling fluid into the first portion, allowing the drilling fluid to flow through the flow ports;

iv. launching the dart into the drilling-fluid stream;

v. pumping cement slurry behind the dart;

vi. continuing to pump cement slurry until the dart lands on the piston inside the dart catcher, blocking fluid flow through the flow ports; and vii. continuing to pump cement slurry until the dart clears the flow ports, causing the piston to move downward into the hydraulic-liquid reservoir, thereby forcing the plug to exit the plug basket.

13. The method of claim 12, wherein:

(1) the system selected for launching cementing plugs in a subterranean well is further characterized by the following:

(a) the plug is a bottom plug and the dart is a bottom dart;

(b) the first portion further comprises:

(i) a top plug in the plug basket;

(ii) a first tubular body that contains a main rod and a rod piston installed on the main rod;

(iii) an opening in the dart catcher through which hydraulic liquid may flow into the first tubular body;

(iv) a second tubular body comprising the ports through which wellbore-service fluids may flow; and (c) the system further comprises a third portion, comprising a top dart; and (2) the method further comprises:

i. pumping drilling fluid through the second tubular body inside the casing string, and allowing the drilling fluid to flow through the flow ports in the second tubular body;

ii. launching the bottom dart into the drilling-fluid stream inside the second tubular body;

iii. pumping a desired volume of cement slurry behind the bottom dart;

iv. launching the top dart into the cement-slurry stream inside the second tubular body;

v. pumping displacement fluid behind the top dart;

vi. continuing to pump displacement fluid until the bottom dart lands on the piston inside a dart catcher, blocking fluid flow through the flow ports;

vii. continuing to pump displacement fluid until the bottom dart clears the flow ports, causing the piston to move downward into the hydraulic-liquid reservoir, thereby forcing hydraulic liquid inside the first tubular body, thereby forcing the rod piston and the main rod into the dart basket, thereby forcing the bottom plug to exit the plug basket;

viii. continuing to pump displacement fluid until the top dart lands on the bottom dart, blocking process-fluid flow through the ports; and ix. continuing to pump displacement fluid until the top dart clears the flow ports, thereby causing the piston to move further downward into the hydraulic-liquid reservoir, thereby forcing hydraulic liquid further inside the casing string, thereby forcing the rod piston and main rod further into the dart basket, thereby forcing the top plug to exit the plug basket.

14. The method of claim 13, wherein the interior volume of the second tubular body is less than the volume of cement slurry necessary to fill the annular region surrounding the casing string, resulting in the launch of the bottom plug before the launch of the top dart.

15. The method of claim 13, wherein the internal diameter of the first tubular body is adjusted such that the axial displacement of the rod piston and the main rod, resulting from the axial displacement of the piston, and the flow of hydraulic liquid into the first tubular body, is sufficient to expel at least one plug.

16. The method of claim 13, wherein the cement slurry is preceded by a spacer fluid, a chemical wash or both.

17. The method of claim 12, wherein:

(1) the system selected for launching cementing plugs in a subterranean well is further characterized by the following:

(a) the plug basket of the first portion is movable and initially contains at least one bottom pug and a top plug;

(b) the first portion further comprises:

(i) a first tubular body through which hydrauic liquid may flow;

(ii) an expandable fluid chamber into which hydrauilc liquid may flow upon displacement through the first tubular body, thereby forcing the movable plug basket to move upward and expel a plug;

(iii) ports in a second tubular body through which wellbore-service fluids may flow; and (c) the second portion comprises at least one bottom dart; and (d) the system further comprises a third portion, comprising a top dart; and (2) the method further comprises the following steps:

i. pumping drilling fluid through the second tubular body inside the casing string, and allowing the drilling fluid to flow through the flow ports;

ii. launching the bottom dart into the drilling-fluid stream inside the second tubular body;

iii. pumping a desired volume of cement slurry behind the bottom dart;

iv. launching the top dart into the cement-slurry stream inside the second tubular body;

v. pumping displacement fluid behind the top dart;

vi. continuing to pump displacement fluid until the bottom dart lands on the piston inside the dart catcher, blocking fluid flow through the flow ports;

vii. continuing to pump displacement fluid until the bottom dart clears the flow ports, causing the piston to move downward into the hydraulic-liquid reservoir, thereby forcing hydraulic liquid through the first tubular body and into the expandable fluid chamber, thereby forcing the movable plug basket to move upward, thereby forcing the bottom plug to exit the movable plug basket;

viii. continuing to pump displacement fluid until the top dart lands on the bottom dart, blocking process-fluid flow through the flow ports; and ix. continuing to pump displacement fluid until the top dart clears the flow ports, thereby causing the piston to move further downward into the hydraulic-liquid reservoir, thereby forcing more hydraulic liquid through the first tubular body and into the expandable fluid chamber, thereby forcing the movable plug basket to move further upward, thereby forcing the top plug to exit the movable plug basket.

18. The method of claim 17, wherein the interior volume of the second tubular body is less than the volume of second process fluid necessary to fill the annular region surrounding the casing string, resulting in the launch of the bottom plug before the launch of the top dart.

19. The method of claim 17, wherein the internal volumes of the fluid reservoir and the first tubular body are adjusted such that axial hydraulic-liquid displacement, and subsequent filling of the expandable fluid chamber arising from the arrival of the dart, are sufficient to cause the movable plug basket to move sufficiently upward to expel a plug.

20. The method of claim 17, wherein the cement slurry is preceded by a spacer fluid, a chemical wash or both.

* * * * *